US005170904A

United States Patent [19]

Neuhaus

[11] Patent Number: 5,170,904

[45] Date of Patent: Dec. 15, 1992

[54] TRASH CAN

[75] Inventor: Josef Neuhaus, Arnsberg, Fed. Rep. of Germany

[73] Assignee: Westermann Kommanditgesellschaft, Arnsberg, Fed. Rep. of Germany

[21] Appl. No.: 713,656

[22] Filed: Jun. 11, 1991

Related U.S. Application Data

[63] Continuation of Ser. No. 516,771, Apr. 27, 1990, abandoned.

[30] Foreign Application Priority Data

Feb. 8, 1990 [DE] Fed. Rep. of Germany ... 9001432[U]

[51] Int. Cl.[5] ..... B65D 43/26; B65F 1/08

[52] U.S. Cl. ..... 220/262; 220/263; 220/264; 220/908

[58] Field of Search ..... 220/263, 264, 262, 908, 220/252

[56] References Cited

U.S. PATENT DOCUMENTS

| | | | |
|---|---|---|---|
| 185,746 | 12/1876 | Hawkins | 220/263 |
| 242,254 | 5/1881 | Bird | 220/264 |
| 1,028,898 | 6/1912 | Moran | 220/264 |
| 1,138,939 | 5/1915 | Deardorff | 220/263 |
| 1,169,606 | 1/1916 | Blank et al. | 220/263 |
| 1,333,051 | 3/1920 | Young | 220/263 |
| 1,481,922 | 1/1924 | Miller | 220/264 |
| 1,552,693 | 9/1925 | Gray | 220/264 |
| 1,682,093 | 8/1928 | Redman | 220/264 |
| 1,714,332 | 5/1929 | Ullrich | 220/263 |
| 2,063,507 | 12/1936 | Karper | 220/263 |
| 2,470,271 | 5/1949 | Steinbacher | 220/264 |
| 2,561,118 | 7/1951 | Horvath | 220/252 |
| 2,663,529 | 12/1953 | Lyttaker | 220/264 |
| 2,665,632 | 1/1954 | Kawa | 220/263 |
| 2,850,025 | 9/1958 | Bond | 220/252 |
| 3,229,846 | 1/1966 | Katz | 220/252 |
| 4,334,629 | 6/1982 | Koch et al. | 220/252 |
| 4,561,563 | 12/1985 | Woods | 220/264 |

FOREIGN PATENT DOCUMENTS

| | | | |
|---|---|---|---|
| 208399 | 2/1908 | Fed. Rep. of Germany | 220/264 |
| 143399 | 11/1935 | Fed. Rep. of Germany | 220/263 |
| 5392 | of 1882 | United Kingdom | 220/263 |
| 257081 | of 1926 | United Kingdom | 220/264 |

*Primary Examiner*—Stephen Marcus
*Assistant Examiner*—S. Castellano
*Attorney, Agent, or Firm*—Martin A. Farber

[57] ABSTRACT

A trash can with dome-shaped head and cover-closed deposit opening (27) arranged in the dome, the cover outer surface of which is adapted to the contour of the dome. The edge of the deposit opening (27) lies on a secant plane of the dome (28) and the cover surface swings parallel to the dome contour downward behind the dome wall from its position protruding above the secant plane.

12 Claims, 6 Drawing Sheets

TRASH CAN

RELATED APPLICATION

This application is a continuation of my co-pending application Ser. No. 07/516,771 filed Apr. 27, 1990, now abandoned.

FIELD AND BACKGROUND OF THE INVENTION

The present invention relates to a trash can having a dome-shaped head and a cover-closed deposit opening which is arranged in the dome, the outer surface of the cover being adapted to the contour of the dome, the edge of the deposit opening lying on a secant plane of the dome, and the cover surface swinging downward parallel to the contour of the dome from its closed position extending above the secant plant into an open position parallel to the dome wall.

Such trash cans are known. In order to fill the trash can, the cover is swung inwardly from the position in which it closes the deposit opening, thereby leaving the contour of the dome. If the trash can is already considerably filled, the inward swinging can be interfered with by expanding trash. Furthermore, the inward swinging of the cover requires considerable space within the dome. In addition, trash can easily become jammed in the deposit opening as the cover moves back, which is unattractive.

SUMMARY OF THE INVENTION

The object of the present invention is to develop a trash can of the type in question in such a manner that its use is more advantageous while being simple to manufacture.

According to the invention a cover surface is swingable through the deposit opening and only within the contour of the dome.

As a result of this development, the utilitarian value of a trash can of this type is increased. The deposit opening is in a particularly favorable position. The trash can can now be filled centrally with respect to its longitudinal direction. It is no longer necessary to introduce the trash laterally. The edge of the deposit opening now lies on a secant plane with respect to the dome of the trash can. Upon the opening of the cover, the surface of the cover swings parallel to the contour of the dome from the position protruding above the secant plane downward behind the wall of the dome. The space required for the movement of the surface of the cover can therefore be kept extremely slight. Maximum filling of the trash can is therefore possible. Even when the trash can is full, the cover does not extend in disturbing manner into the inside of the trash can. Rather, as already stated, the surface of the cover can move along the contour of the wall of the dome. When the cover is closed, the surface of the cover extends over the secant plane of the dome so that the shape of the dome-shaped head is retained.

It is particularly advantageous if the surface of the cover is formed by two parts which are of the same shape as each other, for instance in the form of one-eighth spherical sections. With the trash can closed, these two parts come together in the transverse center plane of the secant plane. The one-eighth spherical sections and secant plane of the dome are so adapted to each other that with the cover parts open, a deposit opening corresponding approximately to a quarter spherical section remains. This makes it possible to introduce even rubbish of large size unimpeded into the inside of the trash can. Stated differently, this means that each of the parts of identical shape corresponds to approximately a quarter section of a dome.

The opening of the cover surfaces can be easily effected by an actuating rod which is raised by the foot pedal. The cover surfaces need not be brought by hand into their spread position in order to have access to the deposit opening.

It is found favorable from a manufacturing standpoint for the actuating rod to terminate in a pusher. The latter, on its part, has two forked arms which extend on both sides of a common pivot point of the two cover parts, each being in pin/slot engagement with a cover part. The corresponding pin/slot engagement is arranged in this connection in the region of the vertex of the spherical sections and therefore in a region below the edge of the deposit opening, and thus in a concealed position. If the foot pedal is moved downwardly, this leads to carrying along the actuating rod which, in its turn, carries the pusher along in downward direction. Hand in hand with this, each cover part is swung around the common pivot point via the pin/slot engagement, namely parallel to the contour of the dome, behind the wall of the dome. Upon the return of the foot pedal into its starting position, the two cover parts assume, in positive fashion, their closed position, extending over the deposit opening and restoring the dome shape of the head.

It is advantageous for the two cover parts to be spring-loaded in the direction of closing. If the foot pedal is no longer acted upon, the spring loading returns the two cover parts into the closed position. In addition, the spring-loading also fulfills the task of returning the foot pedal to its starting position. A tension spring which extends in the region of the vertex of the one-eighth spherical sections and over the closure joint is particularly suitable. The action on the two spherical sections is therefore identical. It is optimal to associate two tension springs lying opposite each other with the one-eighth spherical sections, with substantial avoidance of canting upon the opening and closing of the cover parts. If the trash can is provided with a bottom, then the filling and emptying are effected through the deposit opening. However, there is also the possibility of providing within the trash can an inner can over which the trash can can be placed. The filling is effected as before through the deposit opening. For the emptying, the trash can is pulled up out of its surrounding position, freeing the inner can which can then be emptied by itself. After emptying, the trash can can be brought back into its position surrounding the inner can.

Another advantageous feature of the invention resides in arranging the foot pedal on a yoke-shaped rocker. The latter extends close to the inner wall of the housing of the trash can, parallel to it, over an angle of 180° so that placing an inner can within the trash-can housing is also possible. The rocker then extends within the annular space between inner can and trash-can housing. So that the trash cannot enter into the annular space upon its introduction, the upper edge of the inner can be gripped over by an upper rim ring of the trash-can housing. The rim ring fulfills another function in that it mounts the bearing support. For this purpose, the rim ring is also passed through by the arms of the pusher. The edges of the cover parts which move towards each other also have a twofold function since they form an angling. On the one hand, thin material can be used for the cover parts. The anglings lead to sufficient stiffness. Furthermore, these anglings prevent the danger of injury should one's hand still be present between the cover parts upon the moving back of the spring-loaded cover parts in direction towards each other. The opening displacement of the cover parts is limited by the rim ring of the trash-can housing. The rim ring, also forms a stop for the movement of the cover parts in the direction of opening.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION

Figure 1:
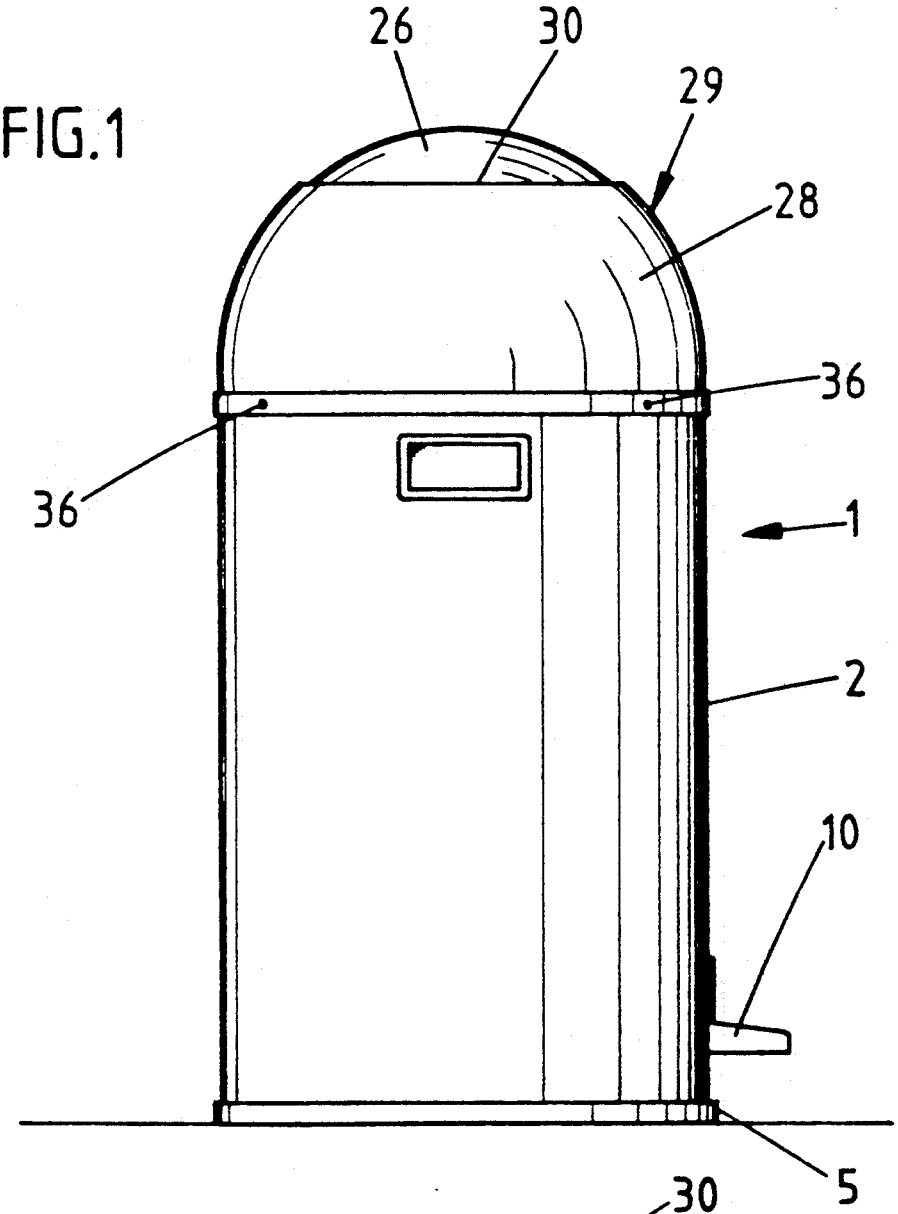
FIG. 1 is a view of a trash can according to the first embodiment, shown in its closed position.
Figure 2:
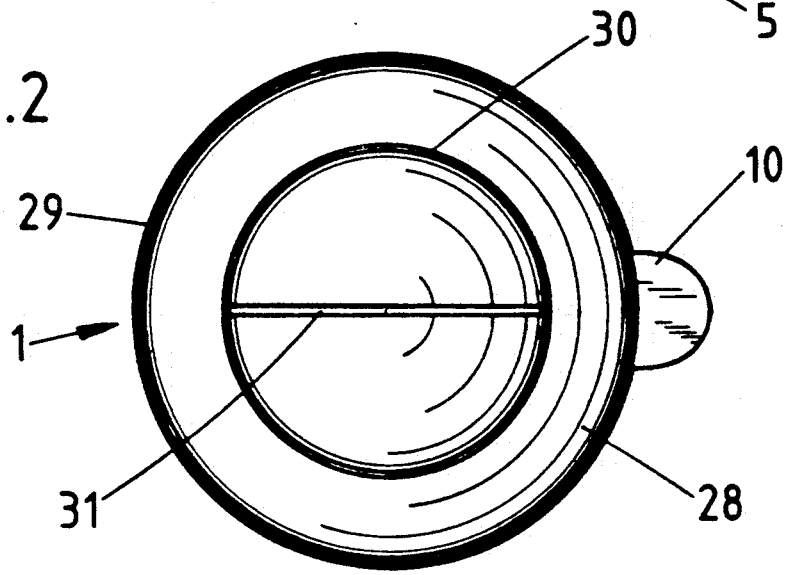
FIG. 2 is a top view of the trash can.

The trash can has a trash-can housing 2 which is placed in concentric alignment over an inner can 3. The lower edge 4 of the trash-can housing 2 is surrounded by a stand collar 5 consisting of rubber or plastic. Within an annular space formed by the lower edge 4 and the stand collar 5 there is mounted a yoke-shaped rocker 6. This rocker extends along the inner wall of the trash-can housing 2 over about 180°. Two diametrically opposite swing bearing pins 7 for the rocker are mounted on the stand collar 5.

Figure 3:
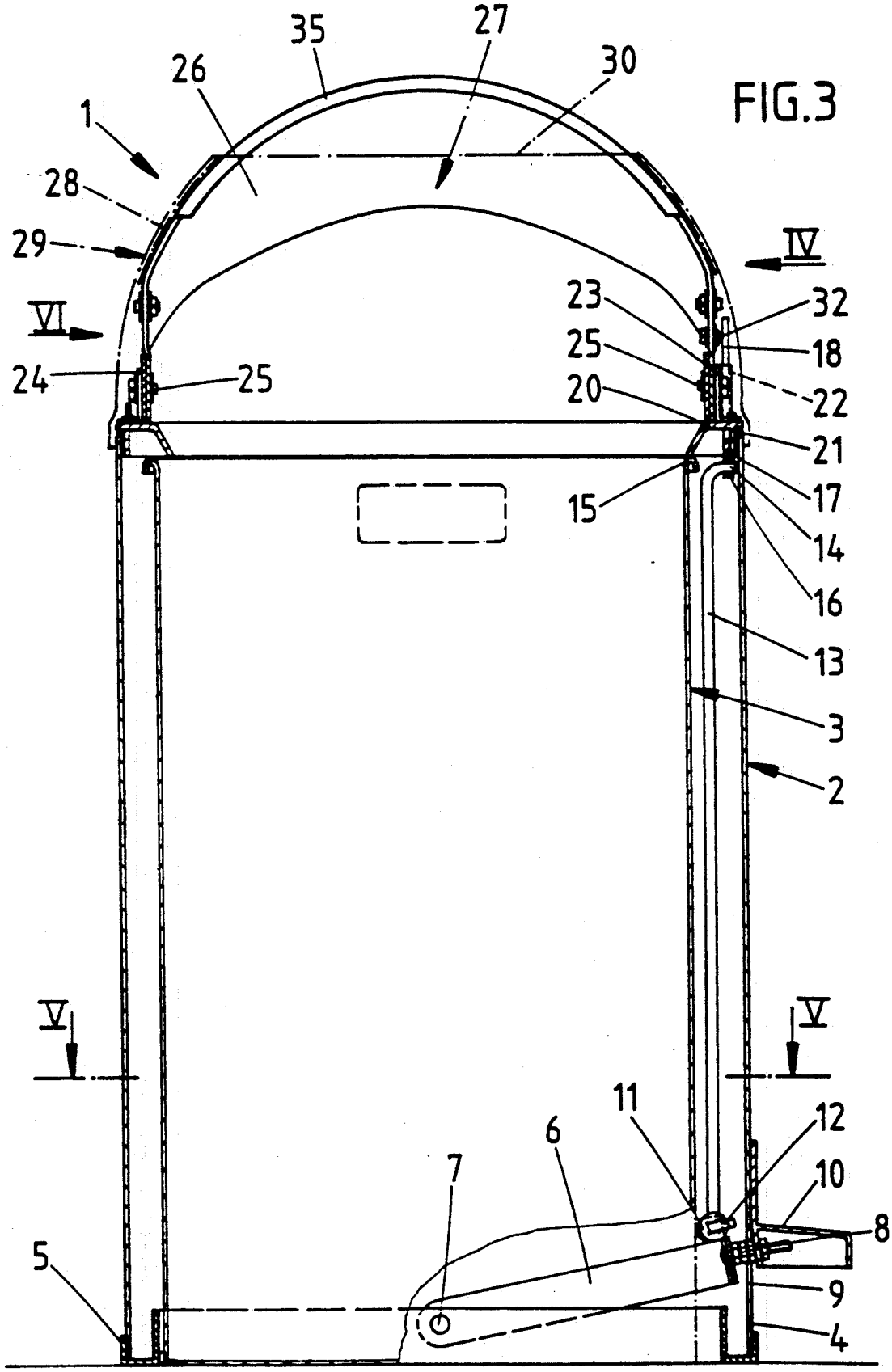
FIG. 3 is a longitudinal section through the trash can at the height of the closure joint of the one-eighth spherical sections, with the dome indicated in dot-dash line.

From the center of the rocker, two extensions 8 protrude, passing through an opening 9 in the lower region of the trash-can housing 2. On the ends extending beyond the trash-can housing, the extensions 8 bear a foot pedal 10. In the starting position of the latter, the yoke-shaped rocker 6 is in an outwardly ascending position; see FIG. 3. Between the extensions 8, the rocker 6 has a mounting bracket 11 through which there extends a bent-off end 12 of an upward-extending actuating rod 13. The upper end of the actuating rod 13 is also provided with a bend 14. This bend passes, at the height of the upper edge 15 of the inner can 3, through a hole 16 in a pusher 17 which forks, forming two upward-directed arms 18. These arms pass through openings 19 of corresponding cross-section in a rim ring 20 which grips over the upper edge 15 and is fastened to the upper front edge 21 of the trash-can housing 2. As can be noted from FIG. 3, the upper end edge 21 extends over the upper edge 15 of the inner can 3.

The arms 18 of the pusher 17 which extend above the rim ring 20 are guided in grooves 22 in a mounting bracket 23. The rim ring 20 serves for holding the latter. Diametrically opposite the mounting bracket 23, the rim ring 20 holds another mounting bracket 24. Each of the two mounting brackets 23, 24 is provided with a pin 25 around which two cover parts 26 of identical shape are mounted in the shape of one-eighth spherical sections. A deposit opening 27 of a dome 28 of a dome-shaped head 29 of the trash can 1 is closed by the cover parts 26. The outer surface of the cover is, in this connection, adapted to the contour of the dome. This is achieved by the edge 30 of the deposit opening 27 lying on a secant plane of the dome 28. The cover surfaces of the two cover parts 26 which are of identical shape extend above the secant plane and supplement the dome 28 so as to form the dome-shaped head 29. The two cover parts 26 come together in a closure joint 31 in the transverse central plane of the plane of swing. The pins 25 which form the common pivot point of the two cover parts 26 pass through the one-eighth spherical sections in the region of the vertex.

The aforementioned arms 18 of the pusher extend on both sides of the common pivot point of the two cover parts and are in pin/slot engagement 32, 33 with the cover part 26, which is flanked by them. The pin/slot engagement is also located in the region of the vertex of the one-eighth spherical sections of the cover parts 26. In detail, each cover part is equipped with a pin 32 which extends into a horizontally-directed slot 33 of the corresponding arm 18.

The two cover parts 26 are spring-loaded in direction of closing. This is achieved by a tension spring 38 which extends in the region of the vertex of the one-eighth spherical sections over the closure joint 31, the ends of which spring are fastened to pin sections 34 of the cover parts 26. In each case two such tension springs 38 are associated with the cover parts 26 above the mounting brackets 23, 24.

Each of the cover parts 26 is provided with a bend 35. By means of these bends the cover parts come against each other in the closure joint 31. The bends 35 prevent the danger of injury and stabilize the one-eighth spherical sections, which consist of thin material.

The dome 28 extends over the front edge 21 of the trash-can housing 2. For the attachment there are used sheet-metal screws 36, which can be noted from FIG. 1, which pass through the lower region of the dome 28, the front edge 21 of the trash-can housing and the rim ring 20 and connect said parts to form a firm, coherent structural unit.

Figure 4:
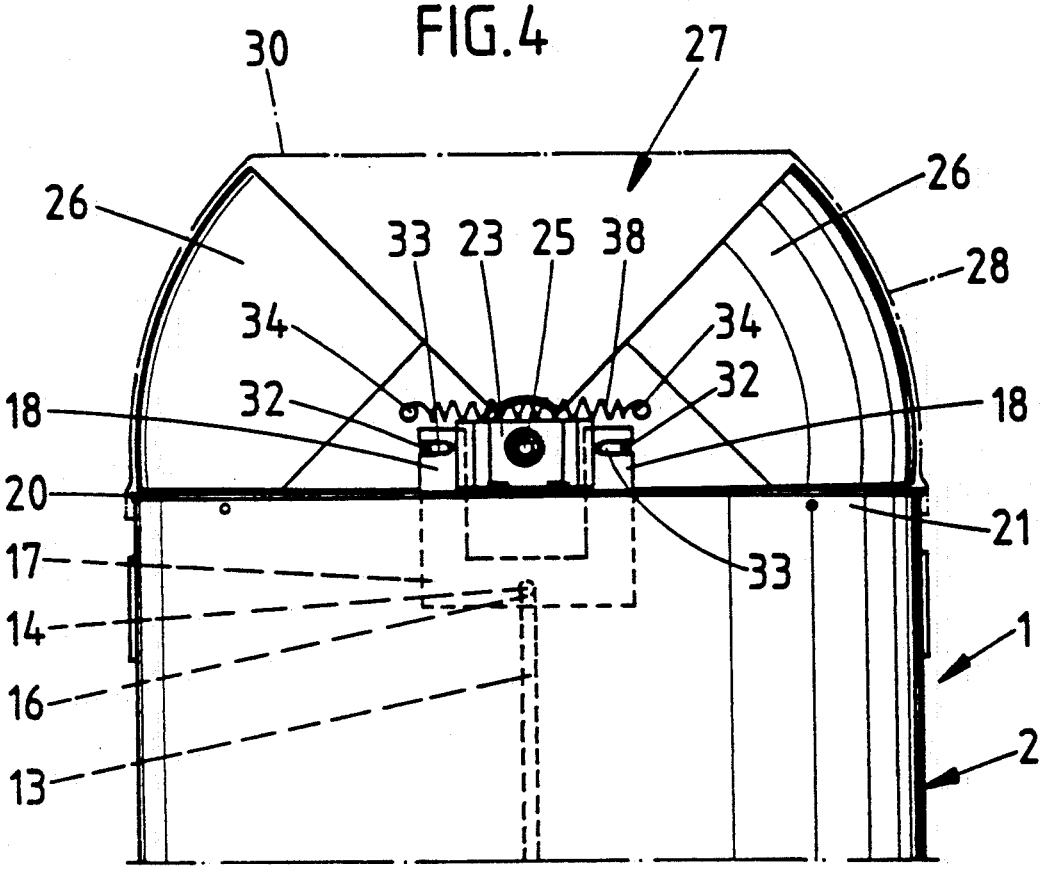
FIG. 4 is a view along the direction of the arrow IV of FIG. 3, with the cover parts in the open position.
Figure 5:
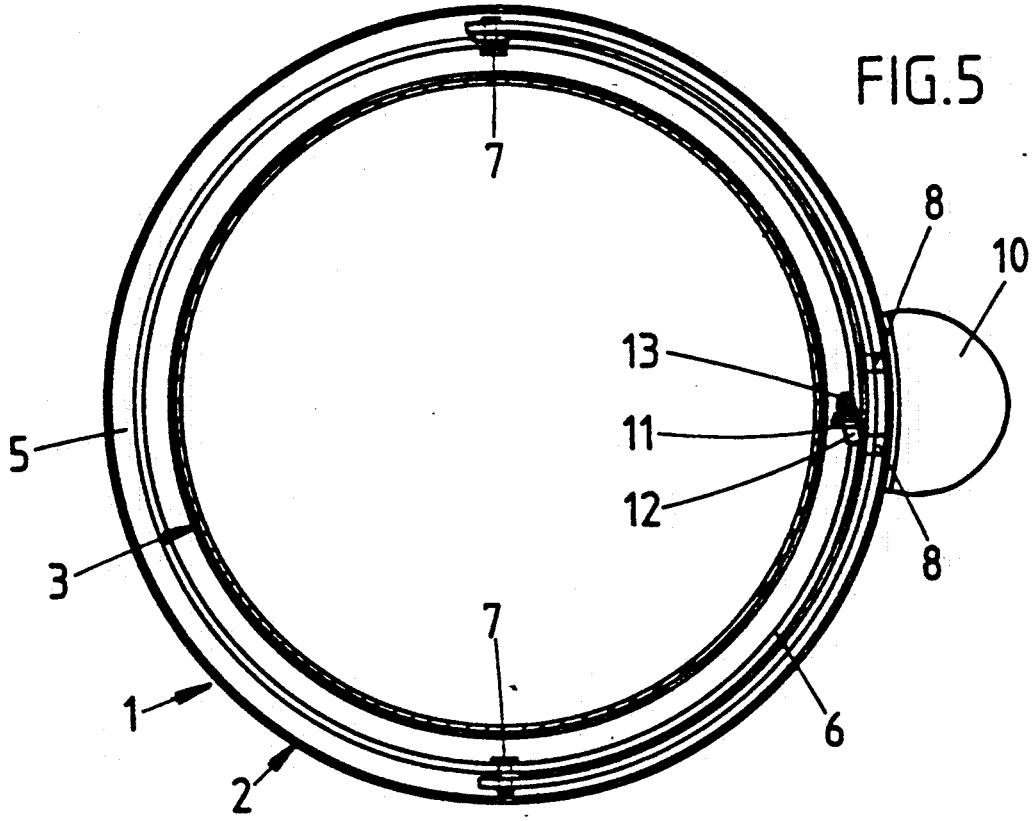
FIG. 5 is a section along the line V—V of FIG. 3.
Figure 7:
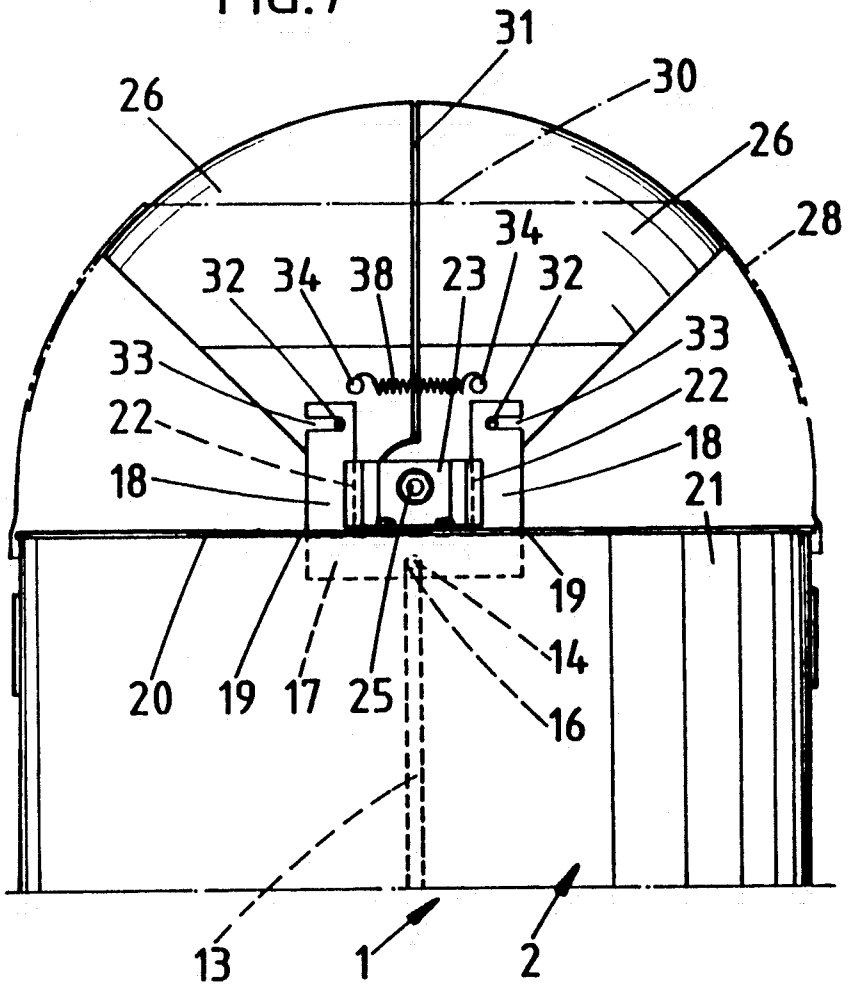
FIG. 7 is a showing similar to FIG. 4 but in the closed position of the cover parts.
Figure 6:
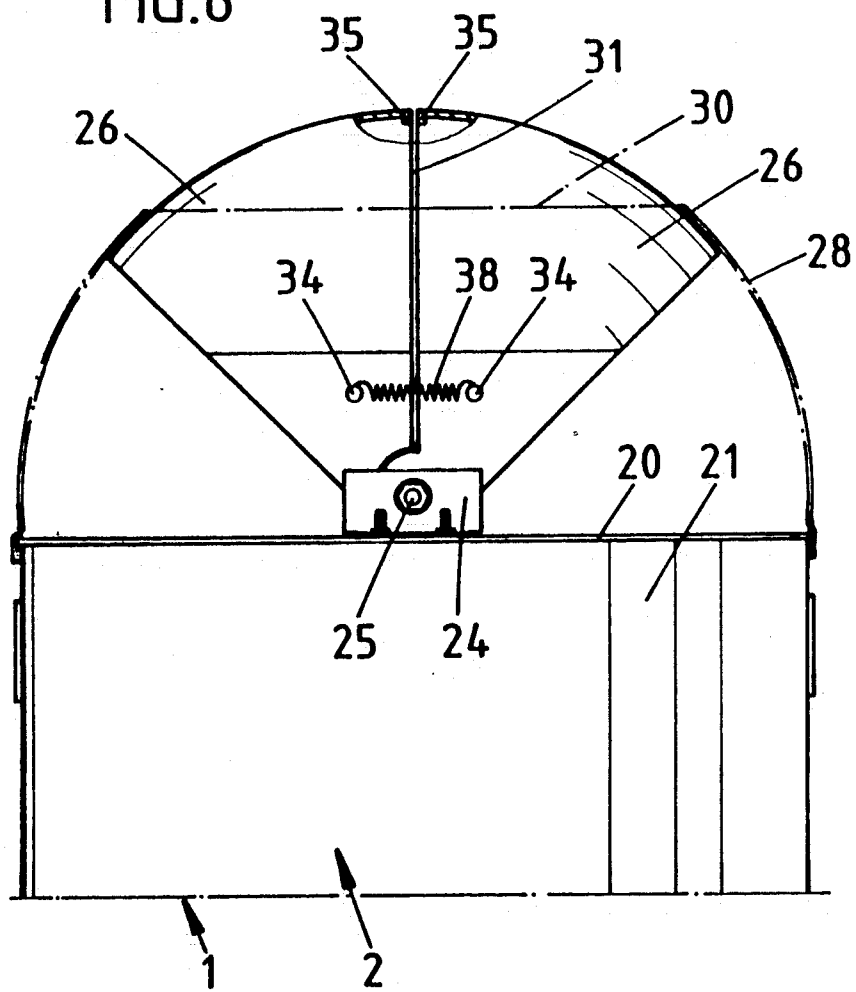
FIG. 6 is a view in accordance with the arrow VI in FIG. 3, in the closed position of the cover parts.
Figure 8:
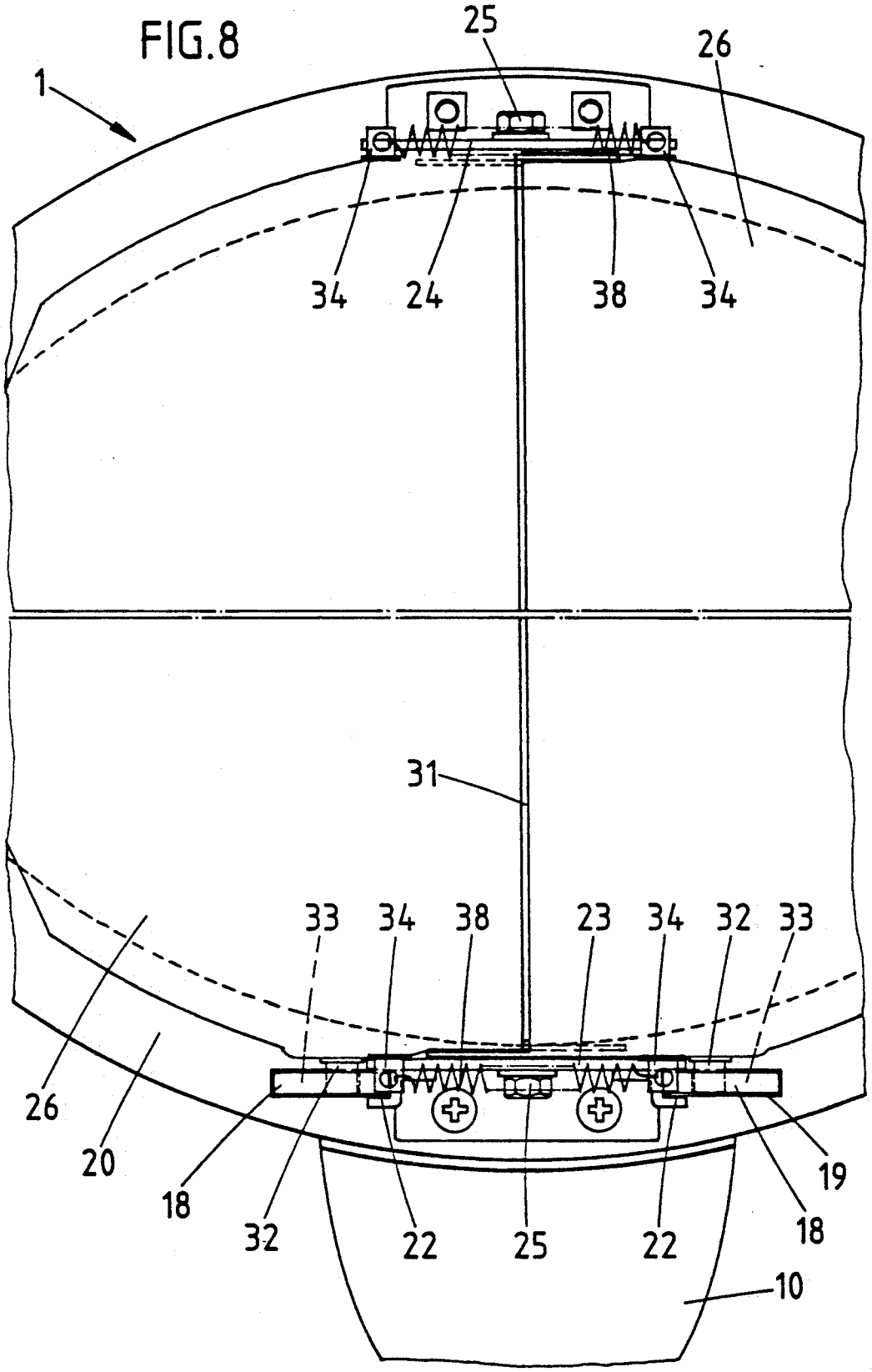
FIG. 8 is a top view of the trash can, with the dome omitted and the cover parts in closed position.

The manner of operation is as follows:

If the trash can or its inner can is to be filled, the foot pedal 10 is actuated in downward direction. Hand in hand with this, it moves in downward direction and also in this way swings the yoke-shaped rocker 6. The actuating rod 13 is thereby carried along, it, in its turn, displacing the pusher 17 out of the position shown in FIG. 7 in downward direction into the position shown in FIG. 4. As a result of the pin/slot engagement 32, 33, the cover parts 26 which are developed in the shape of one-eighth spherical sections, swing behind the dome wall in downward direction out of their position protruding above the secant plane (see FIG. 4) and thereby form a large deposit opening 27. A stop limitation for the downward movement can be produced in the manner that the end edges of the cover parts 26 which are opposite the bends 35 act on the rim ring 20. Similarly a stop limitation, however, could also be obtained by a corresponding length of path of the foot pedal 10 or of the rocker 6. The stop limitation could also be included in the path of the pusher.

During the swinging apart of the cover parts 26, the tension springs 38 are lengthened and accordingly cocked. When the action on the foot pedal 10 is terminated, the tension springs 38 bring the cover parts back into their closed position, the bends 35 striking against each other. Together with the return of the cover parts 26 into their closed position, the pusher 17 is brought back via the pin/slot engagement into its starting position and thus via the actuating rod 13, the foot pedal 10 together with the yoke-shaped rocker 6 are brought back into, their starting position.

For emptying the inner can when it is full, the trash can 1 is lifted out of its position over the latter, the inner can 3 is dumped, and thereupon the trash-can housing is placed over it again.

Figure 9:
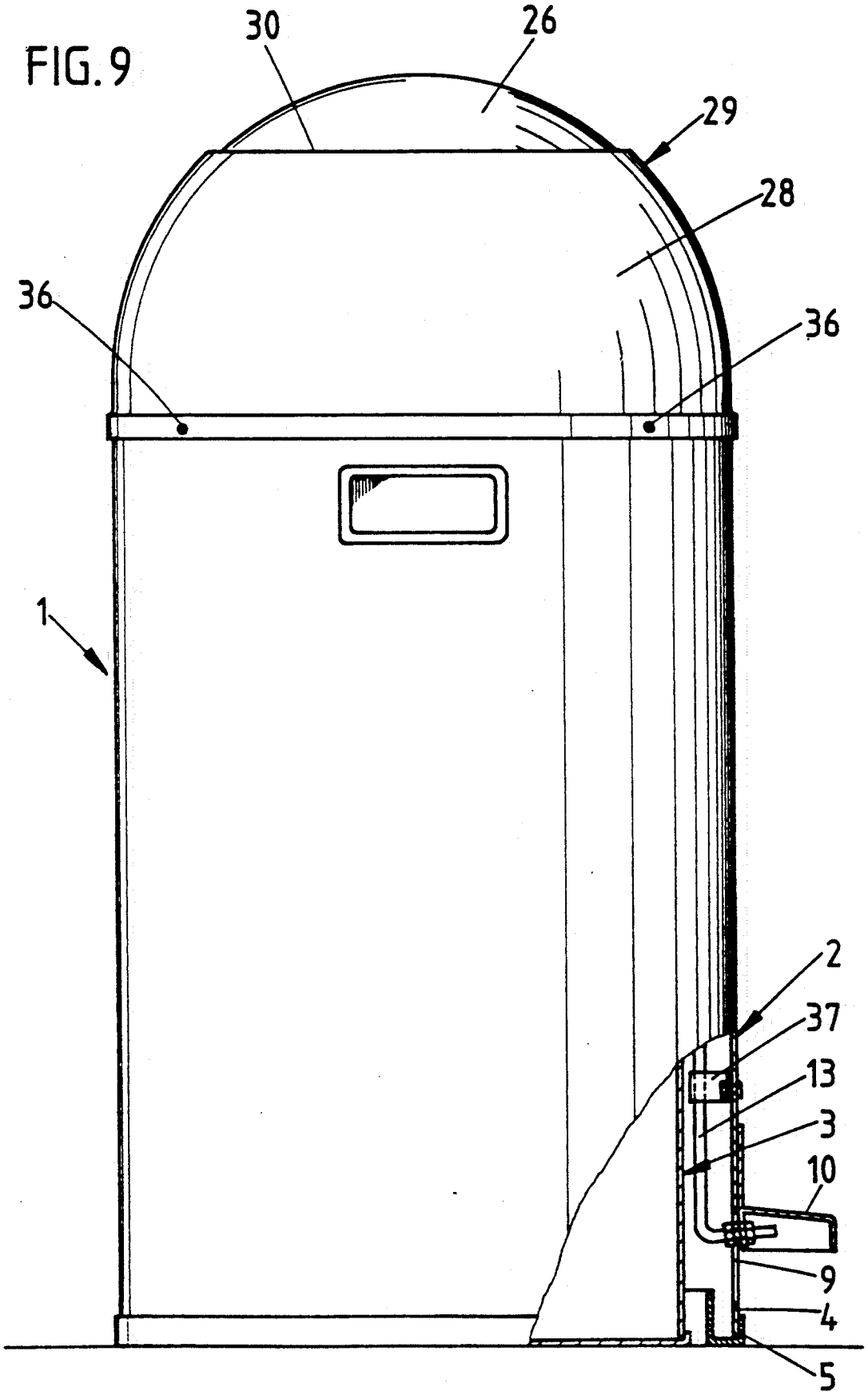
FIG. 9 is a view, partially seen from the outside and partially in section, of the trash can of the second embodiment in which, dispensing with a rocker, the actuating rod is guided in a bracket on the inside of the trash-can housing.

In the modified embodiment shown in FIG. 9, no yoke-shaped rocker 6 is present. In this case, a bracket 37 fastened on the inner wall of the trash-can housing 2 provides sufficient guidance for the actuating rod 13. The remainder of the construction of the trash can corresponds to the embodiment previously described. Therefore identical structural parts bear the same reference numbers.

I claim:

1. In a trash can with a dome-shaped head forming a deposit opening in a dome of the dome-shaped head, a cover closing the opening and having an outer cover surface adapted to the contour of a wall of the dome, an edge of the deposit opening lying on a first secant plane of the dome, a base of the dome lying on a second secant plane spaced apart from the first secant plane, and the cover comprising cover surfaces of two cover parts of identical shape being swingable within the dome and away from each other substantially within the dome contour from their closed position protruding above the first secant plane into an open position between the first and the second secant planes, the cover parts being mounted on two support points disposed opposite each other to serve as a common pivot, the cover parts coming together in the closed position in a transverse center plane perpendicular to the first secant plane and releasing the deposit opening in the open position, the improvement wherein said cover parts are in the form of spherical ⅛th sections which are swingable about said two support points through the deposit opening and solely within the dome contour;

the trash can further comprises a cylindrical trash-can housing having a cylinder edge adjoining the dome contour on a side of the dome-shaped head opposite from the deposit opening;

the trash can further comprises actuating means including spring means for foot actuation of said cover parts opening in opposition to a restoring force of a spring; and an inner can over which said trash-can housing is positioned.

2. In a trash can with a dome-shaped head forming a deposit opening in a dome of the dome-shaped head, a cover closing the opening and having an outer cover surface adapted to a contour of the dome, an edge of the deposit opening lying on a secant plane of the dome, and the cover with said cover surface being downwardly swingable parallel to the contour of the come from a closed position of the cover extending above the secant plane into an open position parallel to the contour of the dome, the improvement wherein said cover with said cover surface is swingable through the deposit opening and only within the contour of the dome;

said cover comprises swingable cover parts;

a housing of the trash can, and an upper ring of the housing; and an edge of said upper ring of the housing of the trash can forms a stop against movement of the cover parts in the open position.

3. In a trash can with a dome-shaped head forming a deposit opening in a dome of the dome-shaped head, a cover closing the opening and having an outer cover surface adapted to the contour of a wall of the dome, an edge of the deposit opening lying on a first secant plane of the dome, a base of the dome lying on a second secant plane spaced part from the first secant plane, and the cover with said cover surface being downwardly swingable within the dome and substantially within the contour of the dome form a closed position of the cover extending above the first secant plane into an open position between the first and the second secant planes, the improvement wherein said cover with said cover surface is swingable through the deposit opening and only within the contour of the dome;

said cover comprises two cover parts of identical shape approximately in a form of one-eighth spherical sections, said cover parts coming together in said closed position in a central plane transverse to the first secant plane;

said trash can comprises a pair of diametrically opposed supports which serve as a common pivot about which each of said two cover parts is pivotally mounted to the trash can;

a foot pedal and an actuating rod which extends upward from the foot pedal; and the cover parts are openable and closeable respectively by foot actuation of said foot pedal.

4. A trash can according to claim 3, wherein in said improvement, the actuating rod terminates in a pusher which is forked forming two arms which extend on two sides of said common pivot point of the two cover parts, each of said arms being in pin/slot engagement with a corresponding one of said cover parts.

5. A trash can according to claim 3, wherein in said improvement, the two cover parts are spring-loaded in direction of the closing of the opening.

6. A trash can according to claim 3, wherein said improvement further comprises two tension springs which are disposed opposite each other for biasing said cover parts into the closed position.

7. A trash can according to claim 3, wherein said improvement further comprises a housing; and an inner container over which said housing is disposed.

8. A trash can according to claim 3, wherein said improvement further comprises a housing for the trash can, the housing having an inner wall; and an arcuate rocker which is approximately semicircular and which extends parallel to said inner wall of the housing of the trash can, said foot pedal being seated on said rocker.

9. A trash can according to claim 3, wherein in said improvement, said cover parts have edges which come against each other in said closed position, and each of said edges have an inward-directed bend of a wall of the cover.

10. In a trash can with a dome-shaped head forming a deposit opening in a dome of the dome-shaped head, a cover closing the opening and having an outer cover surface adapted to the contour of the dome, an edge of the deposit opening lying on a secant plane of the dome, and the cover with said cover surface being downwardly swingable parallel to the contour of the dome from a closed position of the cover extending above the secant plane into an open position parallel to the contour of the dome, the improvement wherein said cover with said cover surface is swingable through the deposit opening and only within the contour of the dome, said cover comprises two cover parts of identical shape approximately in a form of one-eight spherical sections, said cover parts coming together in said closed position in a transverse central plane of the secant plane, means comprising a foot pedal and an actuating rod which extends upward form the foot pedal, and wherein the cover parts are openable and closeable respectively by foot actuation of said foot pedal, said two cover parts are pivotally mounted on the trash can at a common pivot point, the actuating rod terminates in a pusher which is forked forming two arms which extend on two sides of said common pivot point of the two cover parts, each of said arms being in pin/slot engagement with a corresponding said cover part, two mounting brackets on the trash can, each of said mounting brackets have said common pivot point, and said two arms are guided in grooves in one of the two mounting brackets.

11. A trash can according to claim 10, wherein said improvement further comprising a tension spring which is connected to and extends from respective vertex regions of said one-eight spherical sections over a closure joint formed between said sections in the transverse central plane in the closed position of the cover parts, said spherical sections being swingably mounted at respective vertices thereof.

12. A trash can according to claim 10, wherein said improvement further comprises:

a housing of the trash can, and an upper ring of the housing;

an inner container inside said housing;

wherein said upper ring of the housing of the trash can engages over an upper edge of the inner container, said mounting brackets are mounted on said ring, and said arms of the pusher pass through said ring.

* * * * *